US006238024B1

(12) United States Patent
Sawatzky

(10) Patent No.: US 6,238,024 B1
(45) Date of Patent: May 29, 2001

(54) LINKAGE MEMBER FOR AN ANTI-TIP/ INTERLOCK DEVICE

(75) Inventor: Kenneth R. Sawatzky, Kitchener (CA)

(73) Assignee: Waterloo Furniture Components, Ltd., Kitchener (CA)

( * ) Notice: Subject to any disclaimer, the term of this patent is extended or adjusted under 35 U.S.C. 154(b) by 0 days.

(21) Appl. No.: 09/378,008

(22) Filed: Aug. 19, 1999

(51) Int. Cl.[7] ..... E05C 7/06
(52) U.S. Cl. ..... 312/221; 312/218
(58) Field of Search ..... 312/215, 216, 312/217, 218, 219, 220, 221, 222

(56) References Cited

U.S. PATENT DOCUMENTS

| | | | | |
|---|---|---|---|---|
| 3,323,849 | | 6/1967 | Stark . | |
| 3,454,320 | | 7/1969 | Olree . | |
| 3,874,755 | | 4/1975 | Hegg et al. . | |
| 3,881,793 | | 5/1975 | Anderson . | |
| 3,900,236 | | 8/1975 | Goulish et al. . | |
| 3,909,090 | * | 9/1975 | Breckner et al. | 312/217 |
| 4,272,138 | | 6/1981 | Stark . | |
| 4,298,236 | | 11/1981 | Laroche . | |
| 4,355,851 | | 10/1982 | Slusser . | |
| 4,429,930 | | 2/1984 | Blouin . | |
| 4,480,883 | | 11/1984 | Young . | |
| 4,936,640 | | 6/1990 | Pratzer . | |
| 4,966,423 | | 10/1990 | Higuera et al. . | |
| 5,056,877 | | 10/1991 | Westwinkel . | |
| 5,062,678 | | 11/1991 | Westwinkel . | |
| 5,074,627 | | 12/1991 | Broeders . | |
| 5,352,030 | | 10/1994 | Derle et al. . | |
| 5,634,701 | * | 6/1997 | Hendrich et al. | 312/221 |
| 5,855,423 | * | 1/1999 | Cram | 312/221 |
| 5,988,778 | * | 11/1999 | Lammens | 312/217 |

FOREIGN PATENT DOCUMENTS

| | | | | |
|---|---|---|---|---|
| 3818610 | * | 8/1989 | (DE) | 312/221 |
| 0014191 | * | 8/1980 | (EP) | 312/221 |
| 2095322 | | 3/1982 | (GB) . | |
| 2096229 | * | 10/1982 | (GB) | 312/216 |

* cited by examiner

*Primary Examiner*—Peter M. Cuomo
*Assistant Examiner*—Hanh V. Tran
(74) *Attorney, Agent, or Firm*—Banner & Witcoff, Ltd.

(57) ABSTRACT

In a multi-drawer filing cabinet arrangement of vertically disposed drawers mounted on progressive telescopic two or three channel drawer slides, with an interlock mechanism, an improved connecting stub is used. Field installation, assembly, disassembly, replacement or repair of particular cabinet drawer or interlock mechanism can now be accomplished due to the arrangement and configuration of an improved connecting stub for use in an interlock mechanism without taking the file cabinet apart. The connecting stub comprises a partial pocket where the arc segment subtended by the partial pocket is more than 180 degrees and has a predetermined length, thereby allowing lateral or transverse insertion and removal of an associated vertical actuator locking vertical connecting rod without taking the whole filing cabinet apart.

5 Claims, 5 Drawing Sheets

10A
30
15
14
12
31
2A
4
4
13
9
8
16
10B
7
30
31
10C
2B

LINKAGE MEMBER FOR AN ANTI-TIP/ INTERLOCK DEVICE

BACKGROUND OF THE INVENTION

1. Field of the Invention

This invention relates to an interlock mechanism of the type typically incorporated in a multiple drawer vertical filing cabinet. More particularly, this invention relates to a linkage member or connecting stub alone and in combination as used in a filing cabinet drawer interlock mechanism.

2. Description of Related Art

Vertical drawer filing cabinets may have two or more drawers mounted in a cabinet frame vertically one above the other. When one drawer is opened to its fullest extent, for access to the contents thereof, the center of gravity of the cabinet is offset. A common problem with such multi-drawer filing cabinets is the tendency of the filing cabinet to tip if more than one drawer is opened at the same time, possibly causing injury or damage.

File cabinet manufacturers, have for years, installed various devices known as interlock mechanisms in multi-drawer filing cabinets to prevent this occurrence. Such interlock mechanisms employ linkages, activator cams, levers and various other components, so that when one drawer is opened, the interlock mechanism precludes movement of other drawers to an open position. The result is that when one file cabinet drawer is opened, the remainder of the file cabinet drawers are locked and cannot be opened until the first drawer has been returned to a closed or unlocked position. The make up and assembly of a typical filing cabinet and interlocking mechanism requires that the interlocking mechanism be placed inside the filing cabinet at the time the filing cabinet is manufactured. U.S. Pat. No. 5,352,030, titled Anti-Tip Device and issued to Wolfgang Derle and Ronald G. Schenk on Oct. 4, 1994, incorporated herewith by reference, discloses such a prior art cabinet interlock mechanism. Generally, filing cabinets are dependable products. Unfortunately, due to general wear and tear or use, the cabinet components require service or repair from time to time. A drawback of existing filing cabinet interlock mechanisms is that the installation, assembly, disassembly, replacement and repair of the filing cabinet drawers, interlock mechanisms or other cabinet components must be usually done in a particular sequential order and often requires disassembly of the entire filing cabinet including removal of all drawers to effect a minor part repair. This drawback often results from the design of the interlock mechanism components, for example, the design of the linkage member or connecting stub of the interlock mechanism. Such is the situation in the mechanism disclosed in U.S. Pat. No. 5,352,030, titled Anti-Tip Device. This drawback may require that the filing cabinet be taken apart in order to service the filing cabinet's interlock mechanism, which is a very time consuming and expensive proposition.

There is thus a need for an improved connecting stub, or linkage member, that will permit servicing of any damaged drawer, drawer slides, or interlock mechanism without the need to take apart the filing cabinet in any particular sequential order or require removal of all drawers in order to service the interlock mechanism. There is an additional need for an interlock mechanism that may be readily assembled or repaired in the field without removal of all file cabinet drawers.

SUMMARY OF THE INVENTION

Briefly, the present invention is an improvement of the mechanism disclosed in U.S. Pat. No. 5,352,030, the improvement comprising an easily removable and replaceable connecting stub, or linkage member, which is combined with vertical connecting rods, or interconnecting members, that interlink with a series of vertical drawers and activator cams. The improved connecting stub includes a shaped pocket that detachably retains a vertical connecting rod, or interconnecting member. The connecting stub design allows a linkage rod to be "snapped" into the shaped pocket laterally rather than axially. As a result, the vertical connecting rod can be disengaged and replaced in the field. The construction of the connecting stub, which produces a "snap" action, facilitates the installation, assembly, disassembly, replacement or repair of file cabinet drawers, drawers slides or an interlock mechanism in the field without the need to take the entire filing cabinet apart from top to bottom in a sequential order or without removal of all drawers in order to repair the interlock mechanism.

In a preferred embodiment, the connecting stub has at least two adjacent and contiguous sections. A first section is a cam follower surface for interacting with an activator cam mounted on a drawer slide. A second section is a stub pocket, or cutaway annular section or pocket with or without a counterbore opening that will receive the end of a vertical connecting bar, or interconnecting member. The partial pocket is formed or adapted to permit insertion and removal of a vertical connecting bar to and from the partial pocket in a direction lateral or transverse to the normal direction of movement of the stub, i.e. the direction of movement of the connecting stub, or linkage member, when opening or closing the drawer.

In the preferred embodiment, a vertical connecting bar is a cylindrical vertical connecting rod and the connecting stub is a planar cam follower with a stub pocket that comprises a counterbore opening extending slightly axially into the connecting stub and adapted to receive the end of a vertical connecting rod but limited in depth so as to permit removal of the vertical connecting rod laterally from the pocket. The connecting stub further comprises a semi-cylindrical or partially annular pocket that is sized to receive and retain the rod in the partial pocket by elastic tabs, which have an arc segment subtending an angle greater that 180 degrees, that fit over or cover at least partially the vertical connecting rod.

The connecting stub can alternatively be considered to have three adjacent and contiguous sections including a substantially planar cam follower surface, an axial stub pocket and a partial or semi-cylindrical pocket. The substantially planar cam follower surface has an axis of symmetry and an essentially rectangular cross-section with a predetermined length, width and thickness. The stub pocket has a counterbore opening of predetermined depth with an axial center line. The axial center line is substantially parallel to the axis of symmetry of the cam follower surface. The counterbore opening is adapted to receive the end of a vertical connecting rod but limited in depth so as to permit easy removal of the vertical connecting rod from the pocket. The partial pocket has a partial annular section which has an axial center line substantially parallel to the axial center line of the stub pocket. The partial pocket further comprises a top portion, or elastic retention tabs, which subtend an arc segment. The partial pocket receives a vertical connecting rod, or interconnecting member, which is "snapped" and retained in place in substantially coaxial alignment with the axial center line of the stub pocket. The partial pocket permits insertion and removal of the vertical connecting bar to and from the partial pocket in a direction lateral or transverse to the axis of the pocket. Further, in the preferred embodiment, the stub pocket and partial pocket are adapted to receive and retain a vertical connecting rod which has a cross-sectional area configuration that matches the cross-section of the stub pocket and partial pocket.

An object of the present invention is to facilitates the installation, assembly, disassembly, replacement or repair of file cabinet drawers, drawers slides or interlock mechanisms in the field without the need to take the entire filing cabinet apart from top to bottom in a sequential order.

Another object of the present invention is to facilitates the installation, assembly, disassembly, replacement or repair of file cabinet drawers, drawers slides or interlock mechanisms in the field without the need to remove all drawers in order to repair the interlock mechanism.

A further object of the present invention is to facilitate the installation, removal and replacement of connecting stubs and vertical connecting rods in an interlock mechanism in the field without the need to remove all drawers in order to repair the interlock mechanism.

Another object of the present invention is to facilitate the installation, removal and replacement of connecting stubs and vertical connecting rods in an interlock mechanism in the field in a more efficient and cost effective manner.

Another object of the present invention is to facilitate the identification of the connecting stubs by maintenance and service personnel for a more cost effective and efficient servicing of interlock mechanisms in the field.

BRIEF DESCRIPTION OF THE DRAWING

In the detailed description that follows, reference will be made to the drawing comprised of the following figures.

DETAILED DESCRIPTION OF THE PREFERRED EMBODIMENT

Figure 1:
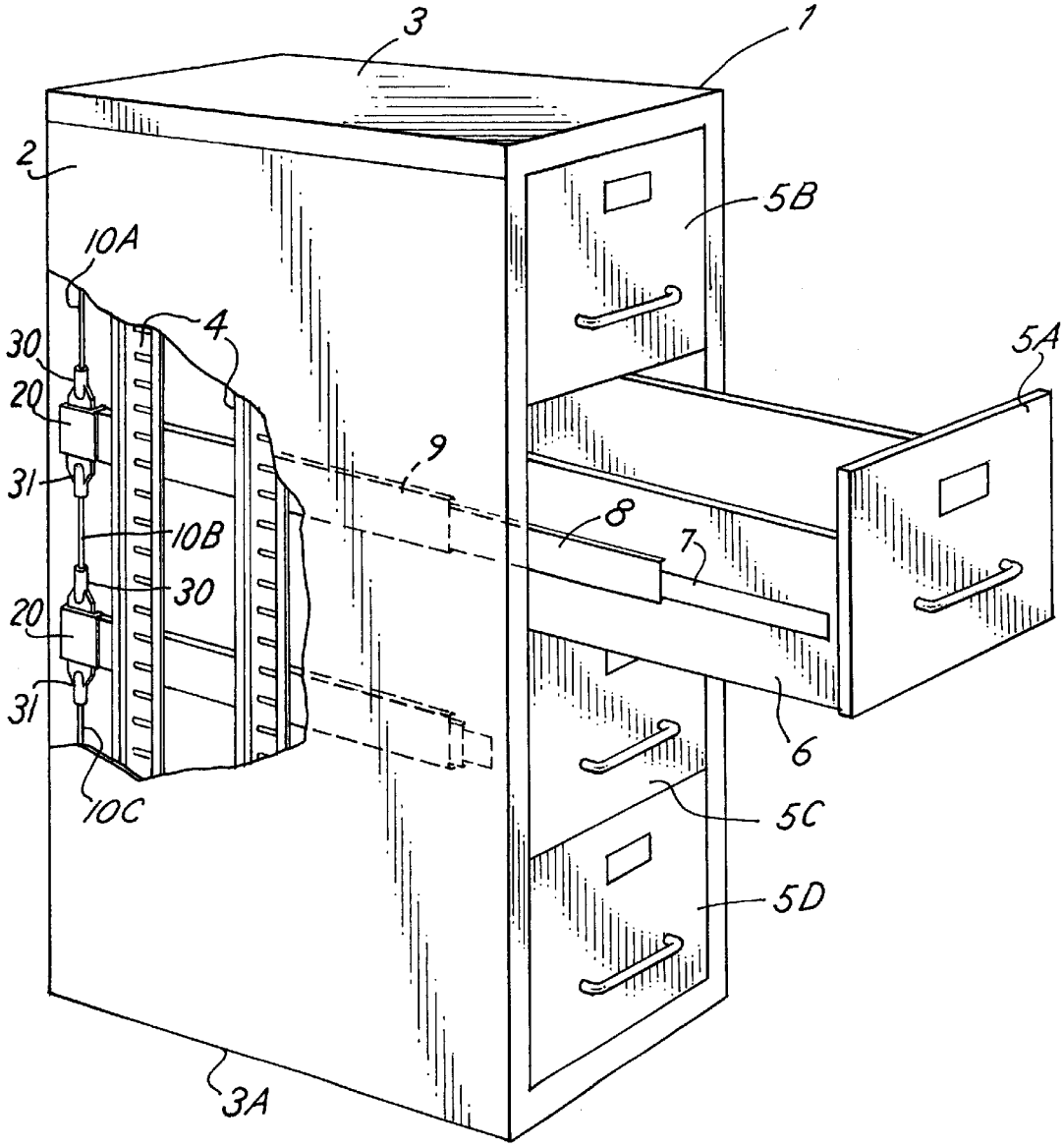
FIG. 1 is an isometric view of a typical prior art filing cabinet with a portion of the side wall removed.

FIG. 1 illustrates a cabinet 1 with multiple vertically arranged drawers 5A, 5B, 5C and 5D. The filing cabinet 1 has a left side cabinet wall 2, a top 3 and a bottom 3A. Drawer 5A is shown in an open position and is mounted on a telescoping channel drawer slide consisting of nested slides 7, 8 and 9. The remaining drawers 5B, 5C and 5D are mounted on similar telescoping channel drawer slides (not shown) in the cabinet 1. Mounted to the side 6 of the drawer 5A, is a small inner channel slide 7, slidably mounted within an intermediate channel slide 8, which is further slidably mounted within an outermost channel slide 9, which is removably attached in guide slots to a pair of vertical supports 4. The vertical supports 4 are further attached to the left side cabinet wall 2.

FIG. 1 depicts the location of an interlock mechanisms or anti-tip assembly 20 within the filing cabinet 1. The interlock mechanism or anti-tip assembly 20 includes a series of connecting stubs 30 and 31 and vertical connecting rods or bars 10A, 10B and 10C which are, in combination, cooperative with activator cams (described below) mounted on the large outer slide 9. The vertical connecting rods 10A, 10B and 10C comprise interconnecting members positioned vertically at right angles to the large horizontally-mounted drawer outer slide 9. The vertical connecting rods 10A, 10B and 10C each include connecting stubs 30, 31 at opposite ends and are mounted to translate movement vertically up and down as the interlock mechanism 20 is operated when a drawer 5A, 5B, 5C or 5C is opened or closed.

Figure 2:
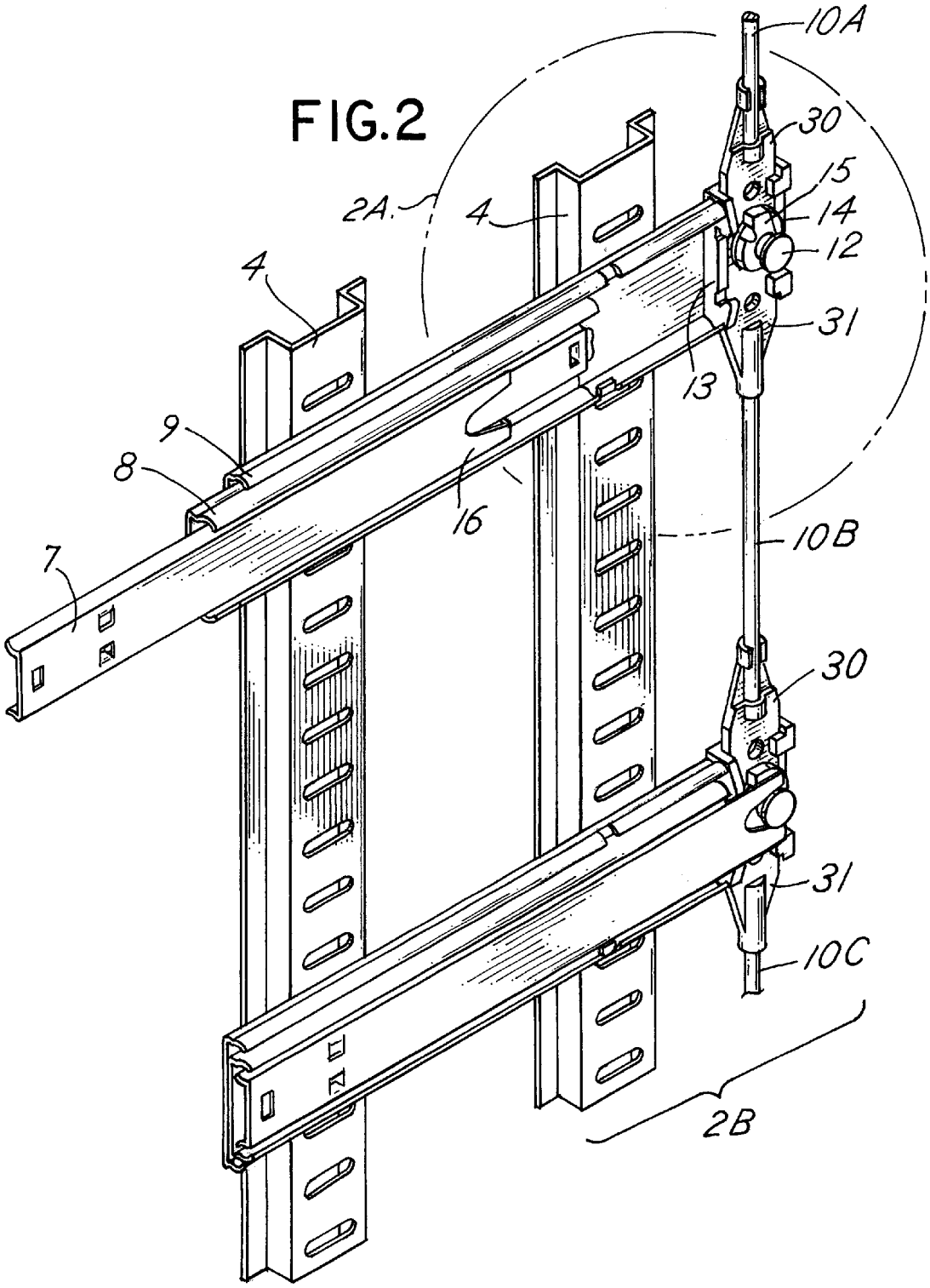
FIG. 2 is an isometric view of a general interlock mechanism or anti-tip assembly, including the connecting stub of the present invention.

FIG. 2 is a view from inside the cabinet looking out toward cabinet wall 2. FIG. 2 shows the general arrangement of a cabinet interlock mechanism or anti-tip assembly 20 associated with the drawers. The drawers have been removed for clarity, while the telescopic drawer slides 7, 8, and 9 remain. FIG. 2 depicts two interlock mechanisms 20. A top interlock mechanism 2A is shown in the drawer open position. The bottom interlock mechanism 2B is shown in the drawer closed position. FIG. 2 further includes a connecting stub 30, an embodiment of the present invention, as it would be used in the field. The connecting stubs 30 and 31 in the interlock mechanism or assembly 20 generally come in pairs in an interlock mechanism 20 and are similarly constructed, as shown in FIG. 2. It is generally known by those skilled in the art that the connecting stubs 30 and 31 have identification characteristics to differentiate them from each other in the field, such as "A" and "B" stub designations. In the preferred embodiment of the present invention, the improvement generally relates to an improved connecting "A" stub. However, it should be noted that a similar improvement could be made to the companion connecting "B" stub 31 in seeking a more efficient and cost effective manner in which to service an interlock mechanism in the field. Additionally, those skilled in the art are aware that various terms or designations are given to the connecting stubs 30 and 31, such as connecting linkage, linkage member, cam surface or cam follower surface among others.

Figure 2A:
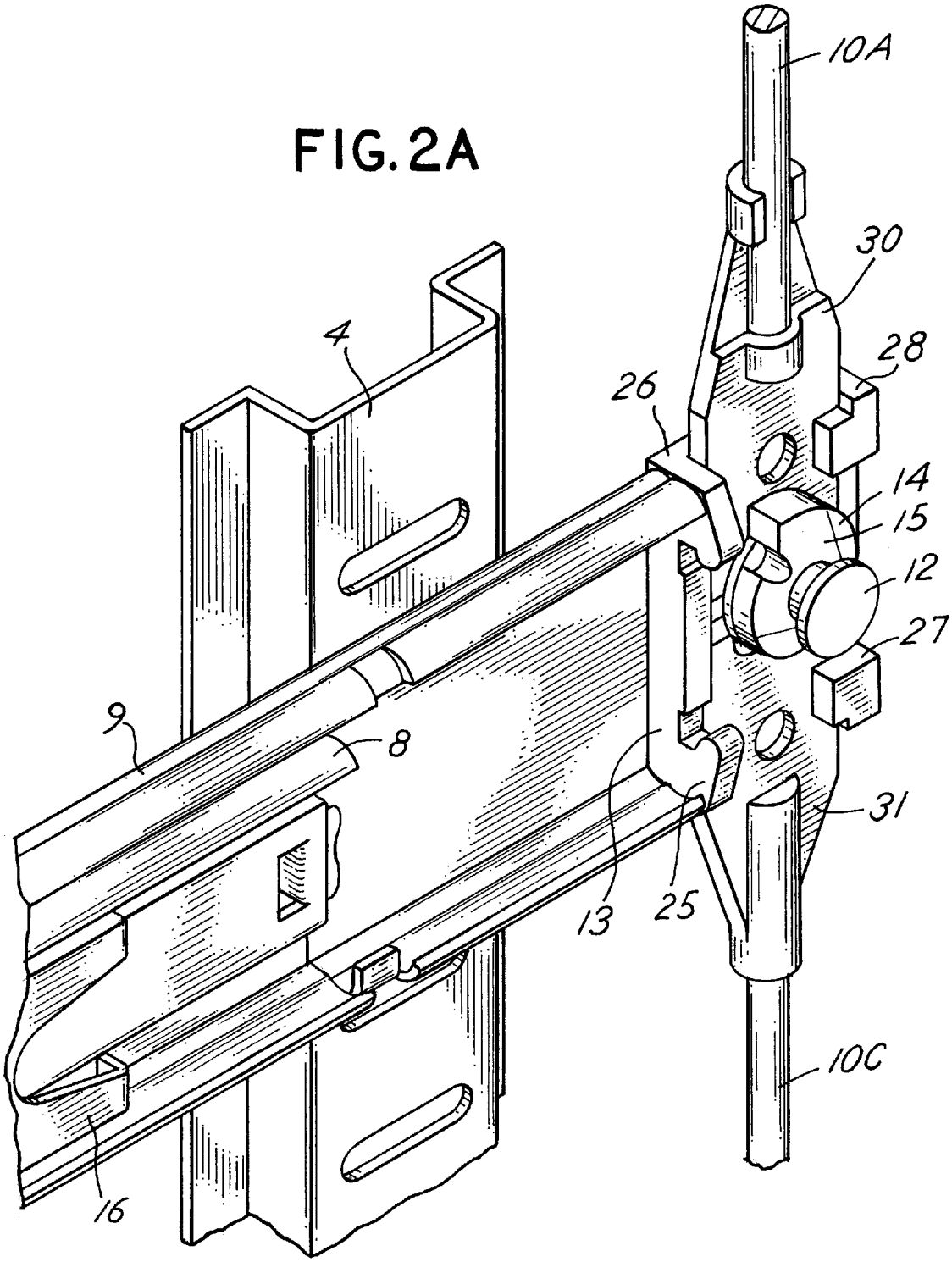
FIG. 2A is an isometric view of a detailed interlock mechanism or anti-tip assembly, including the connecting stub of the present invention.

FIG. 2A is a more detailed view of the top interlock mechanism 2A. The top interlock mechanism 2A is a typical interlock mechanism or assembly 20 and is hereinafter referred to as an interlock mechanism or anti-tip assembly 20. FIG. 2A thus shows a typical interlock mechanism or assembly 20 that includes telescopic drawer slides 7, 8, and 9, a spring base plate 13, an activator cam 14, a rivet 12, a rear activator cam elongated elliptical portion 18 (shown in FIG. 4A), an activator cam L-shaped portion 15, inner drawer slide cam prongs 16, a connecting "A" stub 30, a connecting "B" stub 31 and a corresponding vertical connecting rods 10A and 10B. The spring base plate 13 is mounted to the channel drawer slide 9. The activator cam 14, adjacent to the spring base plate 13, is also attached to the large channel drawer slide 9 by a rivet 12. The spring base plate 13 has two ends 25 and 26 that have vertically aligned apertures 27 and 28 respectively. The apertures 28 and 27 are adapted to receive the ends 41 and 29 (shown in FIG. 4A) of the connecting "A" and "B" stubs 30 and 31 respectively.

Figure 3:
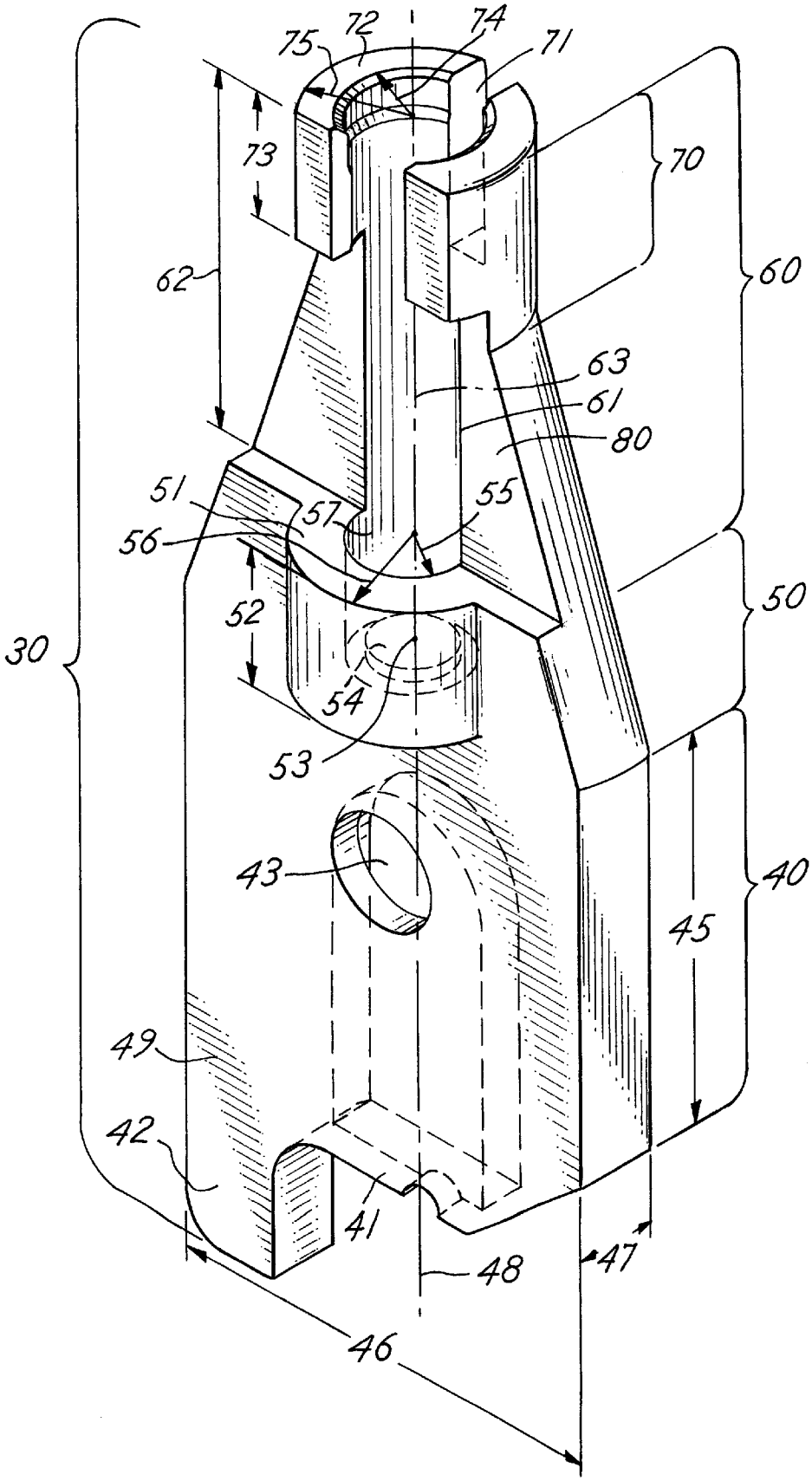
FIG. 3 is a isometric view of the connecting stub of the present invention.

FIG. 3 shows the preferred embodiment of the present invention, a connecting "A" stub 30, which is used in an interlock mechanism 20 (shown in FIGS. 2 & 2A) of a multi-drawer file cabinet 1 (shown in FIG. 1). In the preferred embodiment, the connecting "A" stub 30 is composed of a cam follower surface, or planar section 40, a stub pocket 50 section and a partial pocket 60 section. In the preferred embodiment, these sections may be molded or machined from a single contiguous piece. The connecting "A" stub 30 may also be formed in any manner that comprises these sections which are adjacent and contiguous to each other.

The cam follower surface 40 has an essentially rectangular shape, with a predetermined length 45, width 46 and thickness 47. In the preferred embodiment, the approximate dimensions of the cam follower surface's 40 length 45, width 46 and thickness are 1.168, 0.998 and 0.153 inches respectively. However, these dimensions may vary, so long as the connecting "A" stub 30 remains operable so as to allow easy disassembly and reassembly of a filing cabinet's interlock mechanism in the field, as those skilled in the art will recognize. The cam follower surface 40 also has an axis of symmetry 48. The axis of symmetry 48 serves as reference location for the axial center lines 53 and 63 of a stub pocket 50 and a partial pocket 60 section respectively. In that manner, the cam follower surface 40, stub pocket 50 and partial pocket 60 sections are properly aligned, adjacent to each other and are symmetrical around these axes 48, 53 and 63. The cam follower surface 40 also includes a bottom end 41 and a finger or projection 42. The finger 42 extends outwardly from the lower left end 49 of the cam follower surface's 40 bottom end 41. The finger 42 and bottom end 41 allow the connecting "A" stub 30 to fit into the corresponding vertically aligned aperture 27 of the spring base plate 13 (shown in FIGS. 2 & 2A). The finger 42 is further parallel to the axis of symmetry 48 of the cam follower surface 40.

Referring to FIG. 2A, the cam follower surface 40 and the finger 42 (partially obstructed) are the portions of the connecting "A" stub 30 that directly engage the spring base plate 13 and activator cam 14 of the interlock mechanism 20. When a drawer 5A (shown in FIG. 1) is opened, the interlock mechanism 20 operates. The inner drawer slide's 7 cam prongs 16 engage the L-shaped portion 15 of the activator cam 14. This interaction rotates the activator cam 14. The elongated elliptical section 18, located on the underside of the activator cam 14, (shown in FIG. 4A) rotates and vertically displaces the connecting "A" and "B" stubs 30 and 31 through interaction with the bottom ends 41 and 29 of the "A" and "B" stubs 30 and 31 (shown in FIG. 4A). The vertical displacement of the connecting "A" and "B" stubs 30 and 31 forces the corresponding fingers 42 and 32 of the rest of the connecting stubs 30 and 31 in the file cabinet interlock mechanism 20 to have a reduced "play" between each other. Thereby preventing the rotation of any other activator cams 14. Through this cooperative interaction, the cabinet interlock mechanisms 20 prevent more than one drawer from being opened at the same time. The cooperative interaction of the interlock mechanisms is discussed further in the discussion referring to FIGS. 4A & 4B and is the mechanism, in general, as described in U.S. Pat. No. 5,352,030.

Referring again to FIG. 3, the connecting "A" stub 30 also has a stub pocket 50 section formed to be adjacent to the cam follower surface 40 section. The stub pocket 50 is comprised of a counterbore opening 57 extending axially and parallel to a stub pocket 50 centerline axis 54. The counterbore opening 57 is comprised of a circular cross-sectioned annulus section 51 with a predetermined length 52, an inner radius 55 and an outer radius 56. In the preferred embodiment, the approximate dimensions of the stub pocket's 50 length 53, inner 55 and outer 56 radii are 0.320, 0.220 and 0.095 inches respectively. These dimensions may vary, so long as the connecting "A" stub 30 remains operable to retain a vertical connecting rod 10A (as shown in FIGS. 2 & 2A) so as to allow easy disassembly and reassembly of a filing cabinet's interlock mechanism in the field, as those skilled in the art will recognize. The stub pocket 50 axial center line 53 is substantially parallel to and aligned with the axis of symmetry 48 of the cam follower surface 40. The stub pocket 50 counterbore opening 57 further has a bottom 54 that is adapted to receive a corresponding vertical connecting rod 10A (as shown in FIGS. 2 & 2A) but is limited in depth so as to permit removal of the vertical connecting rod 10A from the counterbore 57 from a drawer open position. After insertion into the stub pocket's 50 counterbore opening 57, the vertical connecting rod 10A will rest on the stub pocket's 50 bottom 54. The cam follower surface 40 and the stub pocket 50 are connected by a web like section 80, which also connects the partial pocket 60 section (discussed below). The web section 80 provides structural support and connects the connecting "A" stub 30 sections in such a manner as to assure proper alignment with each other for use in an interlock mechanism.

The connecting "A" stub further includes a partial or semi-cylindrical pocket 60 section that is formed adjacent to the stub pocket 50 which has a partial or circular cross section 61 with a predetermined length 62 and an axial center line 63. In the preferred embodiment, the approximate diameter of the pocket 60 is 0.645 inches. This dimension too may vary, so long as the connecting "A" stub 30 remains operable (as shown in FIG. 2.) so as to allow easy disassembly and reassembly of a filing cabinet's interlock mechanism in the field, as those skilled in the art will recognize. This axial center line 63 is substantially parallel and aligned to the axial center line 53 of the stub pocket 50 and the axis of symmetry 48 of the cam follower surface 40. The partial pocket 60 further comprises a top portion, or arc or retaining tabs, 70 that subtend an arc segment 72 greater than 180 degrees and centered about the partial pocket's 60 axial center line 63. In the preferred embodiment, the arc segment 72 subtends more than 180 degrees. This feature enables the top portion, or arc tabs, 70 to frictionally grip or clasp a vertical connecting rod 10A (shown in FIGS. 2 & 2A) laterally or transversely inserted therein. In the preferred embodiment, the arc segment 72 may subtend a range greater than 180 degrees up to any subtended angle that will allow the insertion of a vertical connecting rod 10A therein, thereby facilitating the easy disassembly and reassembly of a filing cabinet's interlock mechanism in the field as those skilled in the art will recognize. The insertion or removal of the vertical connecting rod 10A to and from the partial pocket 60 is accomplished by insertion or removal of the vertical connecting rod 10A from a direction lateral or transverse to the partial pocket's 60 center line 63. The arc segment 72 also has a predetermined length 73, an inner radius 74 and an outer radius 75. In the preferred embodiment, the approximate dimensions of the arc segment's 72 length 73, and inner 74 and outer 75 radii are 0.285, 0.095 and 0.220 inches respectively. Again, these dimensions may vary, so long as the connecting "A" stub 30 remains operable to retain a vertical connecting rod 10A (as shown in FIGS. 2 & 2A) so as to allow easy disassembly and reassembly of a filing cabinet's interlock mechanism in the field. The top portion, or arc tabs, 70 of the partial pocket 60 also includes a vertical slot 71 that gives the partial pocket 60 a resilient spring tension for compressively and frictionally holding a vertical connecting rod 10A (not shown) in place, if such a vertical connecting rod 10A has a radius that is slightly larger than the inside radius 74 of the top portion's 70 arc segment 72.

The partial pocket 60 receives a vertical connecting rod 10A of the interlock mechanism (shown in FIGS. 2 & 2A). The vertical connecting rod 10A is inserted from a direction lateral or transverse to the partial pocket's 60 center line 63. The resilient spring tension resulting from the vertical slot 71 and the arc segment 72 being greater than 180 degrees allows a compressive and frictional grip by the top portion, or arc tabs, 70 of the partial pocket 60 on a vertical actuator locking rod 10A. The vertical connecting rod 10A will frictionally mate with the partial pocket 60 and then with the stub pocket's 50 counterbore opening 57. The second partial pocket 60 will frictionally retain the vertical connecting rod in a coaxial alignment with the center line 53 of the stub pocket 50 and with the axis of symmetry 48 of the cam follower surface 40.

In the preferred embodiment, the partial pocket 60 receives the corresponding vertical connecting rod 10A (not shown) by snappingly inserting the vertical connecting rod 10A into the partial pocket 60. The vertical connecting rod is "snapped" into the top portion 70 of the partial pocket 60. The "snap" insertion results from the physical construction, the resilient material used in manufacturing the connecting "A" stub 30 and more particularly from the arc segment 72 that subtends more than 180 degrees. The resilient material, the combination of the arc segment 72 subtending more than 180 degrees and the vertical slot 71 in the top portion 70 give the partial pocket 60 a resilient spring like tension that allows easy assembly and disassembly of an interlock mechanism in the field. This configuration results in a "snap" feature when the vertical connecting rod 10A is inserted in place from a lateral or transverse direction to the partial stub's 60 center line 63. Once "snapped" into place, the vertical connecting rod 10A is slidably mated with the stub pocket's 50 counterbore opening 57. The stub pocket 50 counterbore opening 57 further has a bottom 54 that is adapted to receive the vertical connecting rod 10A (as shown in FIGS. 2 & 2A) but is limited in length 52 so as to permit removal of the vertical connecting rod 10A from the pocket. The partial pocket 60 of the connecting "A" stub 30 allows the installation, assembly, disassembly, replacement or repair of the file cabinet drawers, drawers slides or interlock mechanisms in the field without the need to disassemble the filing cabinet in a specific sequential order, as is the case with prior art interlock devices.

Figure 4A:
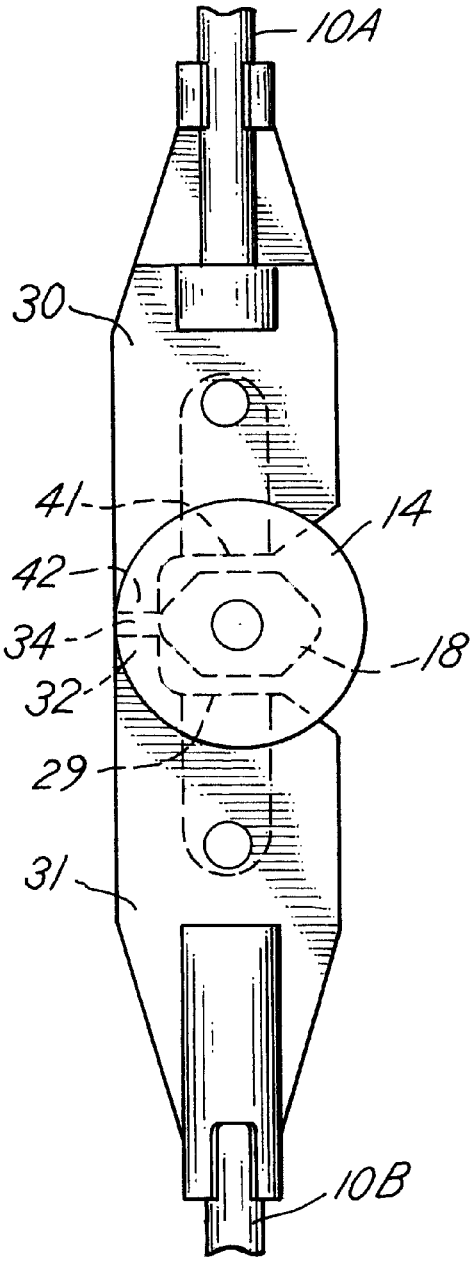
FIG. 4A is a plan view depicting the combination of interconnecting rod elements, activator cam and stubs in a drawer-closed position or drawer unlocked position.
Figure 4B:
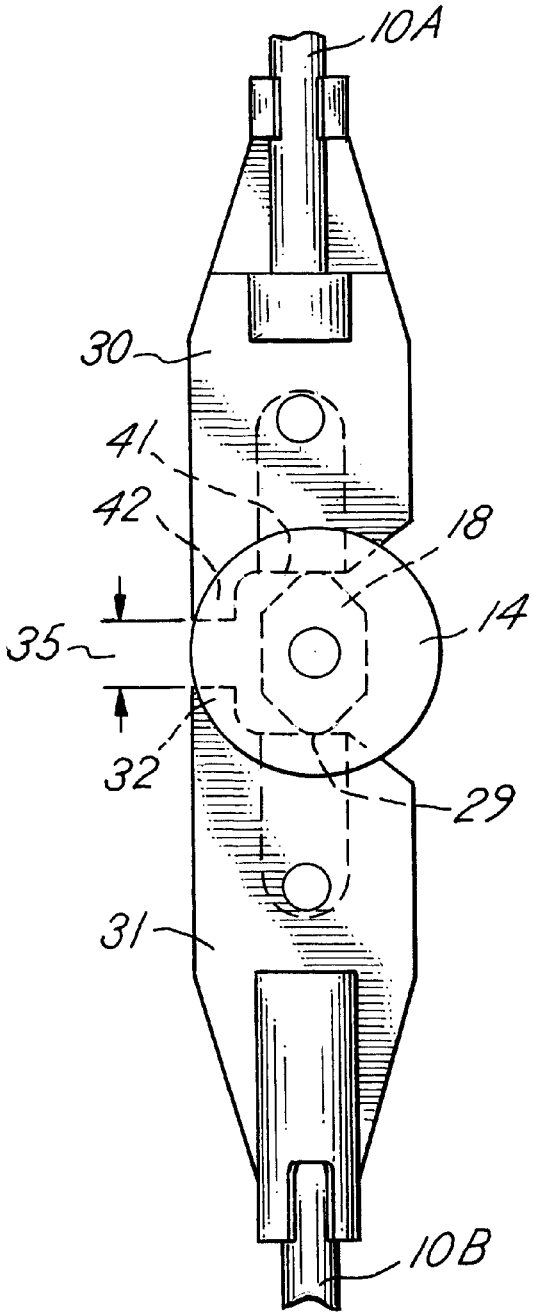
FIG. 4B is a plan view depicting the combination of interconnecting rod elements, activator cam and stubs in a drawer-open position.

FIGS. 4A and 4B are views looking from the inside of the file cabinet (shown in FIG. 1) outwardly in the direction of the left sidewall 2 and illustrate the operation of the present invention in a typical interlock mechanism. For purposes of clarity, only certain components showing the relationship of the present invention 30 to certain other interlock mechanism components are shown. FIGS. 4A and 4B illustrate connecting "A" and "B" stubs 30 and 31, the corresponding vertical connecting rods 10A and 10B and the activator cam 14.

In FIG. 4A, a partial interlock mechanism is shown in a closed or unlocked position which corresponds to a fully closed drawer. When all the drawers in the filing cabinet are closed, each interlock mechanism corresponding to each closed drawer is in the unlocked position shown in FIG. 4A. In the closed position, there is a gap or "play" 34 between fingers 42 and 32 of the connecting "A" and "B" stubs 30 and 31 of each drawer's interlock mechanism. The activator cam's 14 elongated elliptical portion 18 is in a substantially horizontal position and located between the ends 29 and 41 of the connecting "B" and "A" stubs 31 and 30 respectively. The narrow gap or "play" 34 allows the connecting "A" and "B" stubs 30 and 31 to move vertically outward, away from the activator cam 14, so that any one of the closed filing cabinet drawers (shown in FIG. 1) may be opened.

FIG. 4B shows a partial interlock mechanism in a position which corresponds to one drawer being in the opened position. When a particular drawer is opened, its corresponding interlock mechanism 20 (shown in FIGS. 2 & 2A) operates. The inner drawer slide cam prongs 16 engage the L-shaped portion 15 of the activator cam 14 (shown in FIG. 2). This interaction rotates the activator cam 14, which, in turn, rotates the elongated elliptical section 18, located on the underside of the activator cam 14. The elongated elliptical portion 18 takes on a substantially vertical orientation. The elliptical portion 18 of the activator cam 14 is in constant frictional contact with the bottom ends 41 and 29 of the connecting "A" and "B" stubs 30 and 31, or cam followers, respectively. As a result, the elliptical portion 18 of the activator cam 14, which is now vertically oriented, has vertically and outwardly displaced the connecting "A" and "B" stubs 30 and 31, leaving an increased gap of distance 35 between the fingers 42 and 32. The vertical outward displacement of the connecting "A" and "B" stubs is translated to the remainder of the interlock mechanisms in the filing cabinet through the vertical connecting rods 10A and 10B. This movement of components reduces the gap or "play" 34 that was present, in each closed drawer's interlock mechanism, prior to the opening of any one drawer. The remaining interlock mechanisms 20 for the other drawers in the filing cabinet 1 are now in a locked position (shown in FIG. 1) and have their corresponding finger pairs 42 and 32 in closer proximity with each other. The remaining reduced "play" between the fingers of the unopened drawers is sufficient to allow the removal or insertion of the vertical connecting rod 10A inserted in the connecting "A" stub 30 of the opened drawer's interlock mechanism. The vertical connecting rod 10A is slid vertically outward from its stub pocket 50. The vertical distance moved by the vertical connecting rod 10A is sufficient to clear the stub pocket counterbore 57 and in the process eliminates the remaining reduced "play" between the connecting stubs of the unopened drawers. The vertical connecting rod 10A can then be removed from the partial pocket 60 by removing the vertical connecting rod 10A outward in a direction lateral or transverse to the partial stub's 60 center line 63.

Additionally, the remaining reduced "play" between the fingers of the unopened drawers is sufficient to prevent the opening of another drawer. All connecting stubs, with the exception of the two "A" and "B" stubs 30 and 31 immediately adjacent to the vertically positioned elliptical portion 18 of the activator cam 14, will have a reduced "play" with an adjacent connecting stub when a drawer is open. The reduced "play" and the force exerted upon the remainder of the interlock mechanism activator cams, through corresponding connecting "A" and "B" stubs, in attempting to open a second drawer will inhibit rotation of the remainder of the activator cams 14. This essentially locks the other drawers in place and prevents their respective retraction from the cabinet until the opened drawer has been closed.

The connecting stub 30 of the present invention will enable post-manufacture installation, assembly, disassembly, replacement or repair of file cabinet drawers, drawers slides or an interlock mechanism in the field. Referring to FIG. 3, the new connecting "A" stub 30, is configured such that a corresponding vertical connecting rod can be "snapped" into its partial pocket 60 and then slid into and set on its stub pocket 50 counterbore opening 57. The "snap" feature is a result of the partial pocket 60 where the arc segment 72 subtended by the top portion 70 is more than 180 degrees and has a predetermined length 73, thereby allowing the insertion and removal of an associated vertical connecting rod without taking the whole filing cabinet apart. The partial pocket 60 of the connecting "A" stub 30 allows the removal and replacement of an associated vertical connecting rod without the need to take the whole filing cabinet apart.

Although the preferred embodiment of the present invention has been described in considerable detail with reference to a preferred version thereof, it is understood that any minimal or insubstantial variation of the connecting stub 30 is within the spirit of the present invention. FIG. 3 shows the preferred embodiment of the new connecting stub 30, wherein the cross-section of the stub pocket 50 and the partial pocket 60 are generally circular. However, these sections may posses any elliptical cross-sectional area that will mate appropriately with a corresponding vertical connecting rod 10A (shown in FIG. 2 & 2A) of the interlock mechanism 20. The cross-sectional area of the vertical connecting rod 10A generally corresponds to the cross-sectional area of the stub pocket 50 and partial pocket 60 into which the vertical connecting rod 10A will be inserted. In most cases, the actuator locking bar will have a cross-section that matches the stub pocket 50 and partial pocket 60 sections. However, there is no requirement that the stub pocket 50, partial pocket 60 or the vertical connecting rod 10A have a specific cross-sectional configuration. Thus, the cross-sectional area of the stub pocket 50, partial pocket 60 and the vertical connecting rod 10A might be elliptical, circular, square, triangular, tubular, cylindrical or any other cross-section where the corresponding components will interact appropriately with the interlock mechanism used in a multi-drawer file cabinet. In the preferred embodiment the stub pocket 50, partial pocket 60 and vertical connecting rod 10A have circular cross-sectional area configurations as the most readily manufactured embodiment.

In the preferred embodiment of this invention, the connecting stub is composed of 30% glass nylon filled material that is believed to provide the best durability, spring tension resiliency, ease of manufacturing and economical cost. Other materials, however, may be used to make up the connecting stub, including plastics, metals, ceramics or combinations of these materials. Certain characteristics will, in addition, facilitate in the identification of the connecting "A" stub 30 from its companion connecting "B" stub 31 (shown in FIGS. 2 and 4A), by personnel in the field. This will address a problem that exists in the field due to the similar construction of the connecting "A" and "B" stubs in both size and shape. For example, FIG. 3 shows an orifice 43 near its center to assist in stub identification in the field. The connecting "A" stub 30 has also been given a white color to further distinguish it from its companion connecting "B" stub.

Therefore the preferred embodiment is exemplary and the invention is limited only by the following claims and equivalents thereof.

I claim:

1. In an anti-tip assembly for a series of vertical drawers mounted on slides in a file cabinet of the type including a slide bracket attached to the wall of the cabinet for supporting a telescoping slide affixed to a drawer in the cabinet, and further including a rotatably mounted activator cam on the slide bracket, said activating cam rotationally actuated by movement of the telescoping slide between a drawer open position of nonengagement with the cam and a drawer closed position of engagement with the cam, said assembly further including a plurality of connecting rods extending vertically between the drawers, each connecting rod including a separate cam follower attached to the ends of the connecting rods cooperative with said activating cam to drive the connecting rods in a direction between a drawer locking and a drawer unlocking position, the improvement of at least one cam follower adapted to be removable from the associated connecting rod by release from the connecting rod laterally with respect to the movement of the vertical connecting rod, said follower comprising a stub with a stub pocket extending vertically and including a counterbore for receipt of said cooperative connecting rod and a partial pocket extending from said counterbore with a segment portion of said partial pocket subtending more than 180° defining means for retaining said rod by snapping engagement therewith.

2. The assembly of claim 1 wherein said connecting rods are cylindrical and said cam follower includes a semi-cylindrical shaped partial pocket.

3. The assembly of claim 2 further including first and second retention arc segments on the partial pocket to retain said connecting rod.

4. The assembly of claim 1 wherein the cam follower is a unitary molded plastic material.

5. The assembly of claim 1 wherein said stub is comprised of plastic material which is at least 30% glass filled nylon.

* * * * *